United States Patent [19]

Blanc et al.

[11] 4,279,706

[45] Jul. 21, 1981

[54] METHOD AND ASSEMBLY FOR DEPOSITING A METAL ON A CYLINDRICAL BORE WHICH PASSES THROUGH A CENTRAL PORTION OF A LARGE PART

[75] Inventors: Jacques Blanc, Lyons; André Coulon, Bessoncourt; Gilbert Pellus, Evecquemont, all of France

[73] Assignees: Alsthom-Atlantique, Paris; TSM Traitements de Surface et Mecanique, Vigny, both of France

[21] Appl. No.: 153,290

[22] Filed: May 27, 1980

[30] Foreign Application Priority Data

Mar. 27, 1980 [FR] France ..... 80 06834

[51] Int. Cl.[3] ..... C25D 7/04; C25D 17/02; C25D 21/10

[52] U.S. Cl. ..... 204/26; 204/272; 204/273

[58] Field of Search ..... 204/25, 26, 265, 272, 204/273, 277

[56] References Cited

U.S. PATENT DOCUMENTS

| | | | |
|---|---|---|---|
| 2,431,948 | 12/1947 | Martz | 204/272 |
| 2,431,949 | 12/1947 | Martz | 204/26 |
| 3,840,440 | 10/1974 | Durin | 204/25 |

*Primary Examiner*—T. M. Tufariello

*Attorney, Agent, or Firm*—Sughrue, Rothwell, Mion, Zinn and Macpeak

[57] ABSTRACT

A method and assembly for depositing a metal on a cylindrical bore which passes through the central portion of a large part. The invention consists in placing and centering the large part (1) between an upper tank (4) and a lower tank (3), so as to define a chamber (8) inside which the bore (2) is disposed and outside which the peripheral portion (9) of the part (1) extends, said chamber being filled with electrolyte. The electrolyte is homogenized and regenerated continuously by a current which flows between metal anodes (14) in the bore (2) and the part (2) serving as a cathode.

The invention is used for depositing nickel on the bores of turbine rotor wheels so as to adjust dimensions or prevent fretting corrosion.

9 Claims, 1 Drawing Figure

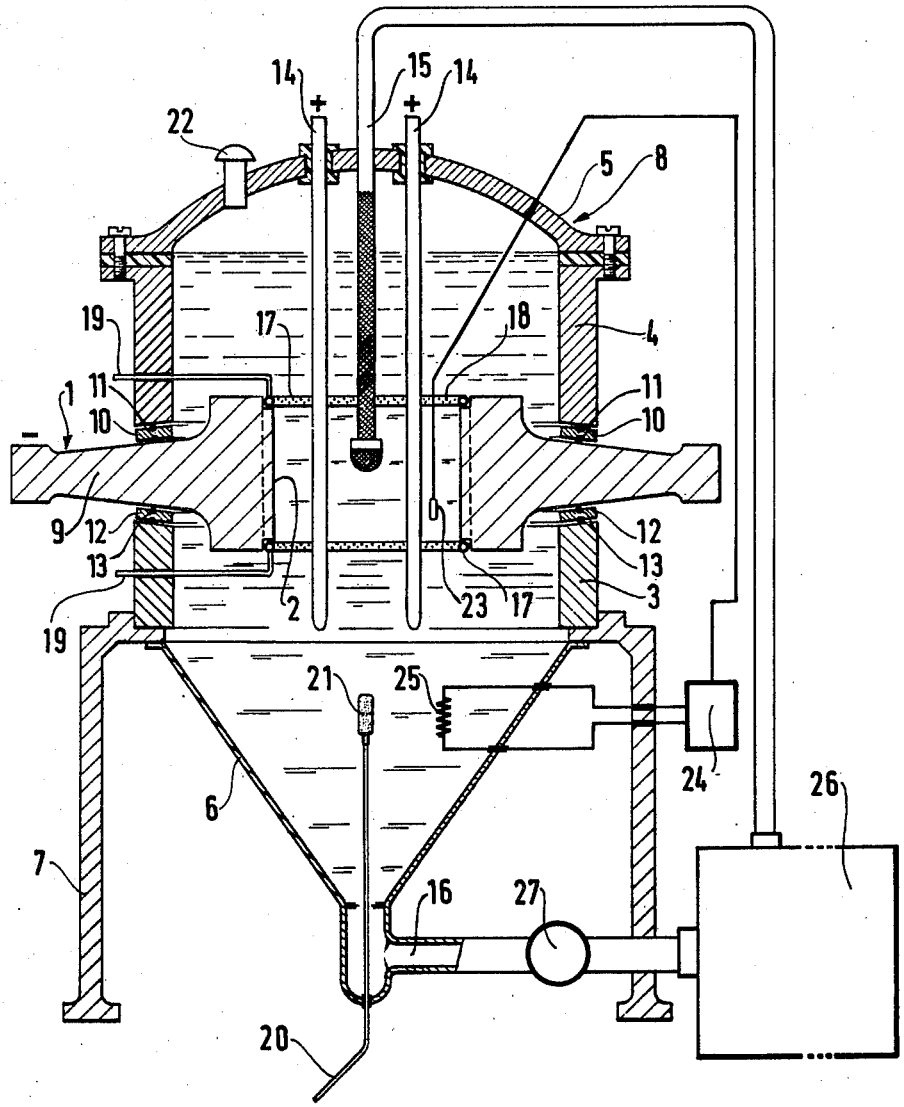
14
15
14
+
+
22
5
8
19
17
18
4
1
11
11
10
10
−
9
12
12
13
13
19
2
23
17
3
21
25
24
26
6
7
16
27
20

METHOD AND ASSEMBLY FOR DEPOSITING A METAL ON A CYLINDRICAL BORE WHICH PASSES THROUGH A CENTRAL PORTION OF A LARGE PART

FIELD OF THE INVENTION

The present invention relates to a method of depositing a metal on a cylindrical bore which passes through the central portion of a large part, e.g. a rotor wheel fretted on a shaft.

BACKGROUND OF THE INVENTION

It is known that when a rotor wheel is unfretted from its shaft to be inspected, it is necessary to adjust the dimension of its bore before fretting it on its shaft again. To adjust the dimension without affecting the characteristics of the basic metal, a sheet of nickel is deposited on said bore.

The bore of a wheel may also be coated with nickel to avoid fretting corrosion which may arise between two fretted parts.

Indeed, it is known that each time it is set in motion, the stress in the rotor of a turbine constituted by wheels fretted on a shaft is distributed in such a way that small differential movements between the fretted parts cause wear such as seizing or friction at the point where they are joined together which leads to particularly active corrosion when the ambient medium is aqueous.

The nickel deposit, which must be moderately or very thick (between 0.1 and several millimeters) is mechanically applied (foils, sockets, etc.).

To improve the quality of the deposit, in accordance with the invention, depositing is by electrolysis.

SUMMARY OF THE INVENTION

In the method of the invention the large part is placed and centered between an upper tank and a lower tank, the tanks having a common vertical axis of symmetry so that the axis of symmetry of the bore coincides with the axis of the tanks and that the two tanks and the part define a chamber inside which the bore is disposed and outside which the peripheral portion of the part extends. Said chamber is filled with electrolyte and the electrolyte is made to flow rapidly between a supply tube which discharges in said chamber and a removal tube situated at the bottom of the lower tank, the electrolyte being regenerated outside the tank when it has been removed and before it is again injected into said chamber through the supply tube, the electrolyte inside the chamber being entrained circularly at the level of the bore of the part and being shaken in all directions in the lower tank; simultaneously a direct current is made to flow between firstly a ring of anodes which are disposed adjacent the bore and symmetrically round the axis of the tanks and secondly the large part which serves as a cathode.

The invention also relates to an assembly which makes it possible to use the above method and which comprises:

a stand equipped with a cylindrical lower tank with a vertical axis;

a cylindrical upper tank whose axis is the same as that of the lower tank;

the two tanks are disposed facing each other and, with the part situated between them, define a chamber which may be filled with electrolyte and inside which there is the bore whose axis coincides with that of the tanks whereas the peripheral portion of the part situated round the bore extends outside said chamber;

sealing means between the lower tank and the part and between the part and the upper tank;

electrolyte supply means discharging inside the chamber;

means for removing the electrolyte and situated at the bottom of the lower tank;

means for making the electrolyte circulate and for regenerating it, said means being situated between the removing means and the supply means;

a ring of anodes made of the metal to be deposited, said anodes being placed inside the bore symmetrically round the axis of the two tanks, the large part serving as a cathode;

means for entraining the electrolyte circularly in the neighborhood of the bore;

means for shaking the electrolyte in all directions in the lower tank; and a pipe communicating with the outside and situated at the upper portion of the chamber.

Due to the arrangement in accordance with the invention, only the central portion of the part is immersed in the electrolyte bath. Thus, the peripheral portions of the part which may be sensitive to the chemical action of the electrolyte are not immersed and further, without taking special precautions, depositing of metal on said peripheral portion is thereby prevented.

Lastly, the arrangement in accordance with the invention is made with small tanks which need not contain the whole of the large part.

To deposit metal evenly on the bore, means are provided which serve to entrain the electrolyte in a circular motion preferably level with the female portion. Said means include one or several tubular rings whose vertical axis coincides with the axis of the tanks and which are located in the immediate neighorhood of the walls of the bore, said ring(s) having small holes through which compressed air is driven towards the inside of the bore in a direction which forms an angle of 45° with the axis of the rings.

In order to homogenize the composition of the electrolyte in the lower tank, means are disposed to shake the electrolyte in all directions. Preferably, these means are constituted by a nozzle supplied with compressed air disposed inside the lower tank and on the axis thereof.

To increase the symmetry of the arrangement as a whole and to enrich the electrolyte where it is the most depleted and thereby to provide a better deposit, preferably, the electrolyte supply means discharge on the axis of the tanks, inside the bore of the part.

In accordance with the invention, the assembly preferably includes means by which the electrolyte inside the tank may be kept at a constant temperature. Said means include e.g. a probe by which the temperature may be detected and an electric resistor which is triggered each time the temperature detected by the probe drops below a given level.

The metal deposited is generally pure nickel which contains less than 0.01% of sulphur.

BRIEF DESCRIPTION OF THE DRAWINGS

Other characteristics and advantages of the invention become apparent from the following description given only by way of a purely illustrating and non-limiting example with reference to the accompanying single FIGURE which schematically illustrates a device in accordance with the invention.

DESCRIPTION OF THE PREFERRED EMBODIMENT

The FIGURE illustrates a turbine rotor wheel 1 whose central portion has a cylindrical bore or female portion 2 which is designed to be fretted onto a shaft.

The wheel 1 is centered between a lower tank 3 and an upper tank 4 which face each other and have the same vertical axis of symmetry. The axis of the bore 2 then coincides with the axis of the tanks 3 and 4. The lower tank 3 has a cylindrical portion placed above a conical bottom portion 6 whose point is turned downwards. The cylindrical portion 3 and the conical portion 6 are connected to a stand 7.

The tanks 3 and 4 and the part 1 define a chamber 8 inside which the bore 2 is located and outside which a peripheral portion 9 of the part 1 extends.

Sealing means are placed between the part 1 and the upper tank 4, said sealing means being constituted by a flat O-ring 10 which withstands the chemical action of the electrolyte and below which are disposed two hollow O-ring seals 11 of circular cross-section.

Likewise, sealing means are placed between the lower tank 3 and the part 1, said sealing means being constituted by a flat O-ring 12 which withstands the chemical action of the electrolyte and above and below which are disposed two hollow O-rings 13 of circular cross-section.

Nickel anodes 14 are disposed in a ring on the generatrices of a cylinder whose axis coincides with that of the tanks. Said anodes are fixed to the cover 5 of the upper tank 4 and extend downwards to the bottom of the cylindrical portion of the lower tank 3 so as to pass right through the bore 2.

A vertical tube 15 is disposed on the axis of the tanks and fixed to the cover 5 of the upper tank 4 and serves to supply electrolyte. It discharges into the middle of the bore 2.

The lower bottom portion of the lower tank 3 is provided with an electrolyte removal orifice 16.

Two hollow rings 17 of tubular cross-section and whose vertical axes coincide with the axis of the tanks are disposed just above and just below the bore 2.

Said hollow rings 17 serve to convey gas under pressure and are provided with multiple orifices 18 directed towards the center of the bore and forming an angle of 45° with the vertical axes of the rings.

Inlet pipes 19 supply gas under pressure to the rings 17 which could also be disposed in the bore. If the bore is small, it is possible to dispose a single ring in the middle thereof.

A compressed air inlet pipe 20 connected to a nozzle 21 provided with multiple holes is set in the axis of the lower tank 3 into which said holes discharge.

A stopper 22 through which gas escapes is provided in the cover 5 of the upper tank 4.

A heat probe 23 is disposed inside the chamber 8 and is connected to an electric cell 24 which sends current to a heating resistor 25 situated in the lower tank when the temperature of the electrolyte varies by 1° C. with respect to the fixed temperature.

The chamber 8 is filled with electrolyte up to just above the upper ring 17. The electrolyte must not reach the stopper 22.

A circuit 26 for regenerating an electrolyte bath and a pump and valve system 27 for injecting the regenerated electrolyte either continuously or intermittently are disposed between the electrolyte removal orifice 16 and the supply tube 15. The electrolyte regeneration and flow circuits are of a conventional type and are not described herein.

The electrolyte bath may be a conventional Watts bath based on 3 salts:

nickel sulphate hydrated with $7H_2O$;
nickel chloride hydrated with $6H_2O$; and
a boric acid $BO_3H_3$.

The electrolyte bath may also consist of a sulfamate which includes:

nickel sulfamate;
sulfamic acid; and
boric acid for buffering.

When the sulfamate bath is used, depositing speeds are higher.

In the arrangement in accordance with the invention using the method in accordance with the invention, direct current is made to flow between the anodes 14 and the part 1 which serves as a cathode. The nickel of the anodes is deposited on the portion of the part situated inside the chamber.

In the electrolyte bath, the cathode film becomes depleted as the nickel is deposited. Therefore, a great flow of electrolyte must be caused the more so as the internal volume of the chamber which contains the electrolyte is small in comparison to the surface to be coated and more especially to the thickness to be deposited.

For the nickel deposit to be even, the bath is circularly entrained in the neighborhood of the bore by flows of compressed air coming from the rings 17 oriented at 45° with respect to the axis of the tanks.

Further, due to the nozzle 21, the bath is homogenized inside the lower tank 3.

The compressed gas which comes from the nozzle 21 and from the rings 17 escapes through the stopper 22.

Of course, the invention is in no way limited to the embodiment described and illustrated, but on the contrary, it covers all the variants thereof.

We claim:

1. A method of depositing a metal on a cylindrical bore which passes through the central portion of a large part, said method comprising the step of:

placing and centering said large part between an upper tank and a lower tank having a common vertical axis of symmetry so that the axis of symmetry of the bore coincides with the axis of the tanks with the two tanks and the part defining a chamber inside which the large part bore is disposed and outside which the peripheral portion of the part extends, filling said chamber with electrolyte, causing the electrolyte to flow rapidly between a supply tube which discharges in said chamber and a removal tube situated at the bottom of the lower tank, regenerating the electrolyte outside the tank when it has been discharged and before it is injected again through the supply tube, entraining the electrolyte inside the chamber circularly at the level of the bore of the part, and shaking it in all directions in the lower tank, and effecting a simultaneously direct current flow between firstly a ring of anodes which are disposed adjacent the bore and symmetrically round the axis of the tanks and secondly the large part which serves as a cathode.

2. An assembly for depositing a metal on a cylindrical bore which passes through the central portion of a large part, said assembly comprising:

a stand equipped with a cylindrical lower tank having a vertical axis and including a bottom;

a cylindrical upper tank whose axis is the same as that of the lower tank;

said two tanks being disposed with ends facing each other and, with the part situated between them to define a chamber which may be filled with electrolyte and inside which there is a bore whose axis coincides with that of the tanks and wherein the peripheral portion of the part situated around the bore extends outside said chamber;

sealing means between the lower tank and the part and between the part and the upper tank;

electrolyte supply means for discharging electrolyte inside the chamber;

means situated at the bottom of the lower tank for removing electrolyte;

means for circulating and regenerating the electrolyte and being situated between the removing means and the supply means;

a ring of anodes made of the metal to be deposited, said anodes being disposed inside the bore symmetrically around the axis of the two tanks, the large part serving as a cathode;

means for entraining the electrolyte circularly in the neighborhood of the bore;

means for shaking the electrolyte in all directions in the lower tank; and a pipe communicating with the outside and situated at the upper portion of the chamber.

3. An assembly according to claim 2, wherein the means which serve to entrain the electrolyte in a circular motion in the neighborhood of the bore includes at least one ring whose vertical axis coincides with the axis of the tanks and which is located in the neighborhood of the walls of the bore, said at least one ring having small holes though which compressed air is driven towards the inside of the bore in a direction which forms an angle of 45° with the axis of said at least one ring.

4. An assembly according to either claim 2 or 3, wherein said means for shaking the electrolyte in all directions is constituted by a nozzle supplied with compressed air and disposed inside the lower tank and on the axis thereof.

5. An assembly according to claim 2 or 4, wherein the electrolyte supply means discharge at the axis of the tanks, inside the female portion.

6. An assembly according to claim 2 or 5, further including means for keeping the electrolyte inside the tank at a constant temperature.

7. An assembly according to claim 6, wherein the means for keeping the electrolyte at a constant temperature includes a probe by which the temperature may be detected and an electric resistor which is triggered each time the temperature detected by the probe drops below a given level.

8. An assembly according to claim 2, wherein the anodes are made of nickel.

9. An assembly according to claim 8, wherein the nickel contains less than 0.01% sulphur.

* * * * *